US011580933B1

(12) United States Patent
Tarabay et al.

(10) Patent No.: US 11,580,933 B1
(45) Date of Patent: Feb. 14, 2023

(54) SYSTEM AND METHOD FOR LUMINANCE COMPENSATION FOR LOCAL AND GLOBAL DIMMING DISPLAYS

(71) Applicant: Faurecia IRYStec Inc., Montreal (CA)

(72) Inventors: Nizar Tarabay, Montreal (CA); Hyunjin Yoo, North Lancaster (CA); Tara Akhavan, Kirkland (CA); Edouard Da Silva, Herblay (FR)

(73) Assignee: Faurecia IRYStec Inc., Montreal (CA)

( * ) Notice: Subject to any disclaimer, the term of this patent is extended or adjusted under 35 U.S.C. 154(b) by 0 days.

(21) Appl. No.: 17/727,447

(22) Filed: Apr. 22, 2022

(51) Int. Cl.
*G09G 5/10* (2006.01)
*G09G 3/20* (2006.01)

(52) U.S. Cl.
CPC ..... *G09G 5/10* (2013.01); *G09G 3/2092* (2013.01); *G09G 2320/0233* (2013.01); *G09G 2320/066* (2013.01); *G09G 2320/0646* (2013.01); *G09G 2320/0686* (2013.01); *G09G 2380/10* (2013.01)

(58) Field of Classification Search
CPC ..... G09G 5/10; G09G 3/2092; G09G 2320/0233; G09G 2320/0646; G09G 2320/066; G09G 2320/0686; G09G 2380/10; G09G 2320/0242; G09G 2320/0276; G09G 2320/06; G09G 2320/0693
See application file for complete search history.

(56) References Cited

U.S. PATENT DOCUMENTS

| | | | | |
|---|---|---|---|---|
| 7,847,986 | B2 * | 12/2010 | Starkweather | H04N 1/6058 358/1.9 |
| 8,207,914 | B2 | 6/2012 | Cok | |
| 9,087,485 | B2 | 7/2015 | Ahn | |
| 9,240,144 | B2 | 1/2016 | Cho et al. | |
| 10,163,389 | B2 | 12/2018 | An et al. | |
| 2010/0201275 | A1 | 8/2010 | Cok | |
| 2011/0187632 | A1 * | 8/2011 | Huang | G09G 3/36 345/88 |
| 2017/0116955 | A1 * | 4/2017 | Stauder | H04N 1/6066 |
| 2018/0130393 | A1 * | 5/2018 | Akhavan | G09G 3/2003 |
| 2018/0277047 | A1 * | 9/2018 | Dai | G09G 3/3413 |
| 2022/0238060 | A1 * | 7/2022 | Kitabayashi | G09G 5/38 |

* cited by examiner

*Primary Examiner* — Antonio Xavier
(74) *Attorney, Agent, or Firm* — Reising Ethington P.C.

(57) ABSTRACT

A system and method is provided for adjusting an input image based on a perceived appearance of the input image on a target display and on an ideal display. The method includes: receiving an input image; determining a target display perceived appearance of the input image, wherein the target display perceived appearance represents a perceived appearance of the input image according to a target display; determining an ideal display perceived appearance of the input image, wherein the ideal display perceived appearance represents a perceived appearance of the input image according to an ideal display; and adjusting the input image based on the target display perceived appearance and the ideal display perceived appearance.

20 Claims, 10 Drawing Sheets

10
BACKEND SERVER 18
Processor(s) 48
Memory 50
26
28
22
LAND NETWORK 20
12
16
Computer 30
Processor 40
Memory 42
Network Access Device 34
14
38
Camera(s)
Display
32
36

SYSTEM AND METHOD FOR LUMINANCE COMPENSATION FOR LOCAL AND GLOBAL DIMMING DISPLAYS

TECHNICAL FIELD

This disclosure relates to methods and systems for luminance compensation for local and global dimming electronic displays.

BACKGROUND

General liquid-crystal displays (LCDs) suffer from the light leakage and a lower contrast ratio than organic light-emitting diode (OLED) displays. Local dimming displays suffer from the halo effect around bright objects in a dark background, and from low brightness in locally dimmed dark zones.

SUMMARY

According to one aspect of the disclosure, there is provided a method for adjusting an input image based on a perceived appearance of the input image on a target display and on an ideal display. The method includes: receiving an input image; determining a target display perceived appearance of the input image, wherein the target display perceived appearance represents a perceived appearance of the input image according to a target display; determining an ideal display perceived appearance of the input image, wherein the ideal display perceived appearance represents a perceived appearance of the input image according to an ideal display; and adjusting the input image based on the target display perceived appearance and the ideal display perceived appearance.

According to various embodiments, the method may further include any one of the following features or any technically-feasible combination of some or all of the following features:

- the target display perceived appearance is determined as a result of a target display simulation, and wherein target display simulation is a simulation of the input image as displayed on the target display;
- the ideal display perceived appearance is determined as a result of an ideal display simulation, and wherein ideal display simulation is a simulation of the input image as displayed on the ideal display;
- a target display simulation outputs the target display perceived appearance as a plurality of luminance values referred to as target display luminance values, and an ideal display simulation outputs the ideal display perceived appearance as a plurality of luminance values referred to as ideal display luminance values
- the ideal display is represented by a plurality of display characteristics including luminance and contrast;
- the adjusting step includes performing a pixel compensation process on the input image, wherein the pixel compensation process is based on the target display perceived appearance and the ideal display perceived appearance;
- the pixel compensation process includes determining a ratio between luminance values representing the ideal display perceived appearance and luminance values representing the target display perceived appearance;
- the ratio is applied to the input image as a part of adjusting the input image to obtain the adjusted input image; and/or

- the pixel compensation process includes a luminance retargeting process that performs luminance retargeting from luminance values of the ideal display perceived appearance to the target display perceived appearance.

According to another aspect of the disclosure, there is provided a method for adjusting an input image based on a perceived appearance of the input image on a target display and on an ideal display. The method includes: receiving an input image; determining a perceived difference in appearance between displaying the input image on a target display and an ideal display, wherein the perceived difference in appearance is based on a simulation of the input image as displayed on the target display; and adjusting the input image based on the perceived difference in appearance between displaying the input image on a target display and an ideal display.

According to another aspect of the disclosure, there is provided an image processing system having at least one processor and memory storing computer instructions that are accessible by the at least one processor. The at least one processor is configured to execute the computer instructions, and, when the at least one processor executes the computer instructions, the system: receives an input image; determines a target display perceived appearance of the input image, wherein the target display perceived appearance represents a perceived appearance of the input image according to a target display; determines an ideal display perceived appearance of the input image, wherein the ideal display perceived appearance represents a perceived appearance of the input image according to an ideal display; and adjusts the input image based on the target display perceived appearance and the ideal display perceived appearance.

According to various embodiments, the method may further include any one of the following features or any technically-feasible combination of some or all of the following features:

- the target display perceived appearance is determined as a result of a target display simulation, and wherein target display simulation is a simulation of the input image as displayed on the target display;
- the ideal display perceived appearance is determined as a result of an ideal display simulation, and wherein ideal display simulation is a simulation of the input image as displayed on the ideal display;
- a target display simulation outputs the target display perceived appearance as a plurality of luminance values referred to as target display luminance values, and an ideal display simulation outputs the ideal display perceived appearance as a plurality of luminance values referred to as ideal display luminance values;
- the ideal display is represented by a plurality of display characteristics including luminance and contrast;
- the adjusting step includes performing a pixel compensation process on the input image, wherein the pixel compensation process is based on the target display perceived appearance and the ideal display perceived appearance;
- the pixel compensation process includes determining a ratio between luminance values representing the ideal display perceived appearance and luminance values representing the target display perceived appearance;
- the ratio is applied to the input image as a part of adjusting the input image to obtain the adjusted input image;
- the pixel compensation process includes a luminance retargeting process that performs luminance retargeting from luminance values of the ideal display perceived appearance to the target display perceived appearance; and/or the image processing system further comprising the target display.

BRIEF DESCRIPTION OF THE DRAWINGS

Preferred exemplary embodiments will hereinafter be described in conjunction with the appended drawings, wherein like designations denote like elements, and wherein.

DETAILED DESCRIPTION

A system and method for adjusting an input image based on a perceived appearance of the input image on a target display is provided. The target display is an electronic display, such as a liquid crystal display (LCD), that the input image (or adjusted input image) is to be displayed on. In some embodiments, the input image is adjusted based on output generated from a simulation of the input image on the target display (the "target display simulation") and a simulation of the input image on an ideal display (the "ideal display simulation"), which is defined or represented by a set of display characteristics. The target display simulation simulates the input image as it would be displayed by the target display and the ideal display simulation simulates the input image as it would be displayed by the ideal display. The word "ideal" should not be interpreted as limiting the type, properties, or configuration of the ideal display or ideal display simulation; rather, this word is used in conjunction with "display" to refer to a theoretical or virtual display that is represented and/or defined by one or more predetermined display properties and/or configurations.

As will be discussed in more detail below, the input image is adjusted based on information obtained as a result of the target display simulation and the ideal display simulation, which simulate the perceived appearance of the input image as it would appear on the target display and as it would appear on the ideal display. A perceived difference in output of the two simulations then may be determined and used to inform processing that is then carried out on the input image so as to obtain an adjusted input image that is then displayed on the target display. According to some embodiments, the difference in output may be a ratio of luminance between the output of the target display simulation and the ideal display simulation, may be an output of a luminance retargeting process that performs luminance retargeting from the output of the ideal display simulation (as the source) to the output of the target display simulation (as the target), or a combination thereof.

Figure 1:
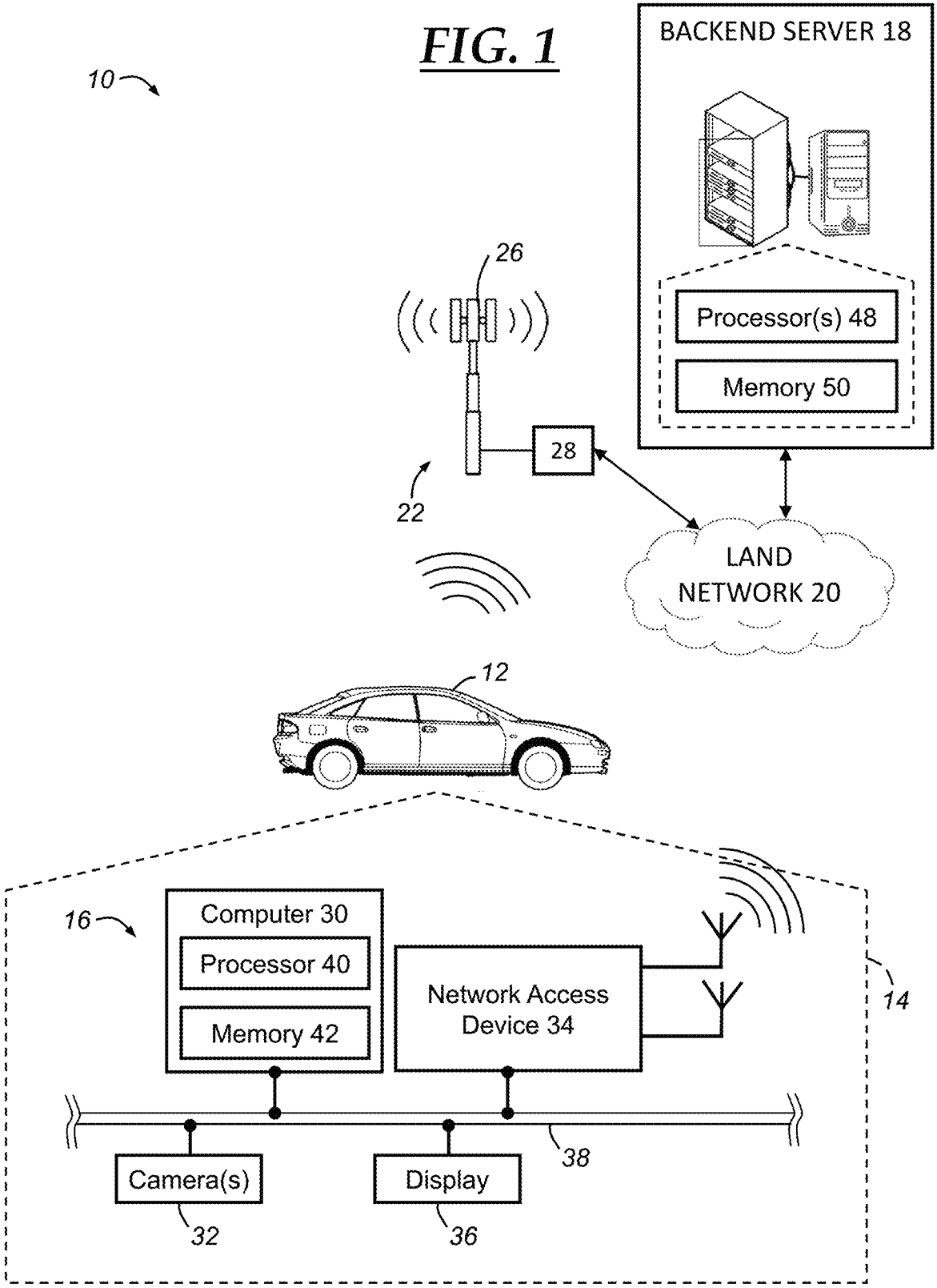
FIG. 1 is an operating environment that includes an image processing system that may be used to carry out one or more of the methods described herein.

With reference now to FIG. 1, there is shown an operating environment that comprises a communications system 10, a vehicle 12 having vehicle electronics 14 including an image processing system 16, one or more backend servers 18, a land network 20, and a wireless carrier system 22. According to at least some embodiments, the image processing system 16 is configured to carry out one or more of the methods described herein, such as methods 200 (FIG. 11), 300 (FIG. 12), and/or 400 (FIG. 13). It should be appreciated that while the image processing system 16 is discussed in the context of a vehicular application, the image processing system 16 may be used as a part of a variety of other applications or contexts, such as where the image processing system 16 is incorporated into a handheld mobile device (e.g., smartphone), a personal computer (e.g., laptop, desktop computer), or cloud processing system.

The land network 20 and the wireless carrier system 22 provide an exemplary long-range communication connection between the vehicle 12 and the backend server(s) 18, for example. Either or both of the land network 20 and the wireless carrier system 22 may be used by the vehicle 12, the backend server(s) 18, or other component for long-range communications. The land network 20 may be a conventional land-based telecommunications network that is connected to one or more landline telephones and connects the wireless carrier system 22 to the backend server(s) 18. For example, the land network 20 may include a public switched telephone network (PSTN) such as that used to provide hardwired telephony, packet-switched data communications, and the Internet infrastructure. One or more segments of the land network 20 may be implemented through the use of a standard wired network, a fiber or other optical network, a cable network, power lines, other wireless networks such as wireless local area networks (WLANs), or networks providing broadband wireless access (BWA), or any combination thereof.

The wireless carrier system 22 may be any suitable long-range data transmission system, such as a cellular telephone system. The wireless carrier system 22 is shown as including a single cellular tower 26; however, the wireless carrier system 22 may include additional cellular towers as well as one or more of the following components, which may depend on the cellular technology being used: base transceiver stations, mobile switching centers, base station controllers, evolved nodes (e.g., eNodeBs), mobility management entities (MMEs), serving and PGN gateways, etc., as well as any other networking components used to connect the wireless carrier system 22 with the land network 20 or to connect the wireless carrier system 22 with user equipment (UEs, e.g., which may include telematics equipment in the vehicle 12), all of which is indicated generally at 28. The wireless carrier system 22 may implement any suitable communications technology, including for example GSM/GPRS technology, CDMA or CDMA2000 technology, LTE technology, 5G, etc. In at least one embodiment, the wireless carrier system 22 implements 5G cellular communication technology and includes suitable hardware and configuration. In some such embodiments, the wireless carrier system 22 provides a 5G network usable by the vehicle 12 for communicating with the backend server(s) 18 or other computer/device remotely located from the vehicle 12. In general, the wireless carrier system 22, its components, the arrangement of its components, the interaction between the components, etc. is generally known in the art.

The one or more backend servers (or backend server(s)) 18 may be used to provide a backend for the vehicle 12, image processing system 16, and/or other components of the system 10. In at least one embodiment, the backend server(s) 18 includes one or more computers or computing devices (collectively, "computers") that are configured to carry out one or more steps of the methods described herein, such as the methods 200 (FIG. 11), 300 (FIG. 12), and/or 400 (FIG. 13). In another embodiment, the backend server(s) 18 is used to store information concerning and/or pertaining to the vehicle 12 or image processing system 16, such as predetermined graphics (or other images) and/or predetermined tone curves that may be used as a part of a pixel compensation technique, as described below. The backend server(s) 18 may be implemented or hosted by one or more computers, each of which includes a processor and a non-transitory, computer-readable memory that is accessible by the processor.

The vehicle 12 is depicted in the illustrated embodiment as a passenger car, but it should be appreciated that any other vehicle including motorcycles, trucks, sports utility vehicles (SUVs), recreational vehicles (RVs), bicycles, other vehicles or mobility devices that can be used on a roadway or sidewalk, etc., can also be used. As depicted in the illustrated embodiment, the vehicle 12 includes the vehicle electronics 14, which include an onboard vehicle computer 30, one or more cameras 32, a network access device 34, an electronic display (or "display") 36, and a vehicle communications bus 38. FIG. 1 provides an example of certain components of the vehicle electronics 14, however, it should be appreciated that, according to various embodiments, the vehicle electronics 14 may include one or more other components in addition to or in lieu of those components depicted in FIG. 1.

The one or more cameras 32 are each used to obtain image data of the vehicle's environment, and the image data, which represents an image captured by the camera(s) 32, may be represented as an array of pixels that specify color information. The camera(s) 32 may each be any suitable digital camera or image sensor, such as a complementary metal-oxide-semiconductor (CMOS) camera/sensor. The camera(s) 32 are each connected to the vehicle communications bus 6 and may provide image data to the onboard vehicle computer 30. In some embodiments, image data from one or more of the camera(s) 32 is provided to the backend server(s) 18. The camera(s) 32 may be mounted so as to view various portions within or surrounding the vehicle.

The network access device 34 is used by the vehicle 12 to access network(s) that are external to the vehicle 12, such as a home Wi-Fi™ network of a vehicle operator or one or more networks of the backend server(s) 18. The network access device 34 includes a short-range wireless communications (SRWC) circuit (not shown) and a cellular chipset (not shown) that are used for wireless communications. The SRWC circuit includes an antenna and is configured to carry out one or more SRWC technologies, such as any one or more of the IEEE 802.11 protocols (e.g., IEEE 802.11p, Wi-Fi™), WiMAX™, ZigBee™, Z-Wave™, Wi-Fi Direct™ Bluetooth™ (e.g., Bluetooth™ Low Energy (BLE)), and/or near field communication (NFC). The cellular chipset includes an antenna and is used for carrying out cellular communications or long-range radio communications with the wireless carrier system 22. And, in one embodiment, the cellular chipset includes suitable 5G hardware and 5G configuration so that 5G communications may be carried out between the vehicle 12 and the wireless carrier system 22, such as for purposes of carrying out communications between the vehicle 12 and one or more remote devices/computers, such as those implementing the backend server(s) 18.

The display 36 is an electronic display that is used to display graphics or images, and may be, for example, a LCD or an OLED display. According to some embodiments, the display 36 is the target display of the methods 200 (FIG. 11), 300 (FIG. 12), and 400 (FIG. 13). In one embodiment, the display 36 is a global dimming display and, in another embodiment, the display 36 is a local dimming display. A local dimming display is a display with multiple backlight zones that are controlled independently to deliver different backlight distribution across the display. A global dimming display does not have multiple backlight zones that are controlled independently, but is a display where the backlight is spread uniformly over the liquid crystal panel or other display panel (in non-LCD applications). In one embodiment where the display 36 is a local dimming display, the display 36 may have 384 zones in a 12×32 array configuration.

The onboard vehicle computer 30 is an onboard computer in that it is carried by the AV 16 and is considered a vehicle computer since it is a part of the vehicle electronics 18. The onboard vehicle computer 30 includes at least one processor 40 and non-transitory, computer-readable memory 42 that is accessible by the at least one processor 40. The onboard vehicle computer 30 may be used for various processing that is carried out at the vehicle 12 and, in at least one embodiment, forms at least a part of the image processing system 16 and is used to carry out one or more steps of one or more of the methods described herein, such as the methods 200 (FIG. 11), 300 (FIG. 12), and/or 400 (FIG. 13). The onboard vehicle computer 30 is connected to the vehicle communications bus 38 and may send messages to, and receive messages from, other vehicle components using this bus 38. The onboard vehicle computer 30 may be communicatively coupled to the network access device 34 so that data may be communicated between the onboard vehicle computer 30 and a remote network, such as the backend server(s) 18.

The image processing system 16 is used to carry out at least part of the one or more steps discussed herein. As shown in the illustrated embodiment, the image processing system 16 is implemented by one or more processors and memory of the vehicle 12, which may be or include the at least one processor 40 and memory 42 of the onboard vehicle computer 30. In some embodiments, the image processing system 16 may additionally include the display 36. In one embodiment, at least one of the one or more processors carried by the vehicle 12 that forms a part of the image processing system 16 is a graphics processing unit (GPU). The memory 42 stores computer instructions that, when executed by the at least one processor 40, cause one or more of the methods (or at least one or more steps thereof), such as the methods 200 (FIG. 11), 300 (FIG. 12), and/or 400 (FIG. 13) discussed below, to be carried out.

The backend server(s) 18 are shown as including one or more processors 48 and non-transitory, computer-readable memory 50. In one embodiment, the backend server(s) 18 are used to carry out one or more steps of one or more methods described herein, such as the methods 200 (FIG. 11), 300 (FIG. 12), and/or 400 (FIG. 13) discussed below. In such embodiments, the backend server(s) 18 may be configured so that, when computer instructions stored on the memory 50 are executed by the processor(s) 48, the backend server(s) 18 causes certain steps and/or functionality to be carried out, such as any of the functionality attributed to the backend server(s) 18 as discussed herein. In one embodiment, the processor(s) 48 and the memory 50 storing the computer instructions may form an image processing system that is configured to carry out one or more steps of one or more methods described below.

Any one or more of the processors discussed herein may be implemented as any suitable electronic hardware that is capable of processing computer instructions and may be selected based on the application in which it is to be used. Examples of types of processors that may be used include central processing units (CPUs), graphics processing units (GPUs), field-programmable gate arrays (FPGAs), application specific integrated circuits (ASICs), microprocessors, microcontrollers, etc. Any one or more of the non-transitory, computer-readable memory discussed herein may be implemented as any suitable type of memory that is capable of storing data or information in a non-volatile manner and in an electronic form so that the stored data or information is consumable by the processor. The memory may be any a variety of different electronic memory types and may be selected based on the application in which it is to be used. Examples of types of memory that may be used include including magnetic or optical disc drives, ROM (read-only memory), solid-state drives (SSDs) (including other solid-state storage such as solid state hybrid drives (SSHDs)), other types of flash memory, hard disk drives (HDDs), non-volatile random access memory (NVRAM), etc. It should be appreciated that any one or more of the computers discussed herein may include other memory, such as volatile RAM that is used by the processor, and/or multiple processors.

Figure 2:
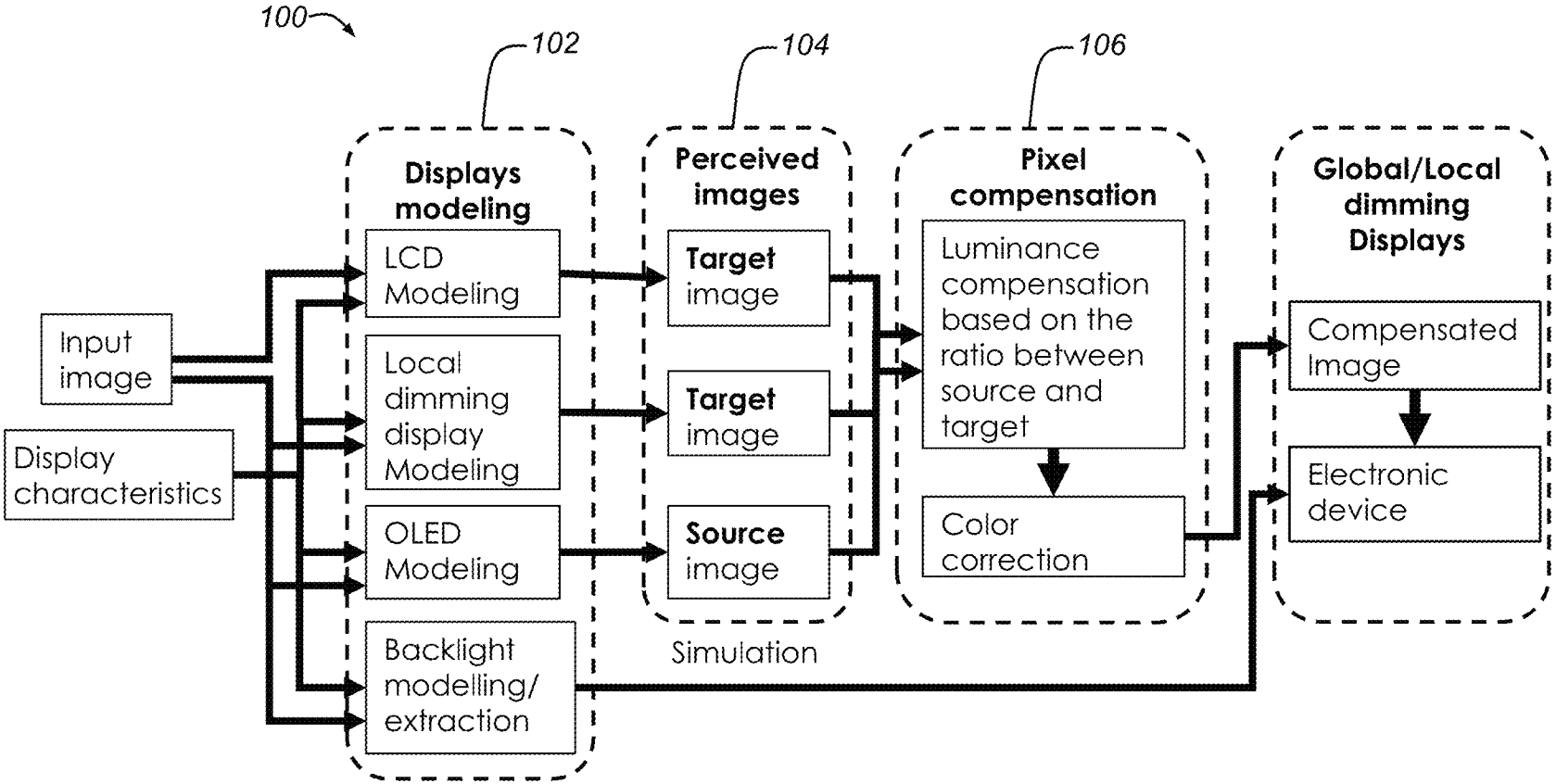
FIG. 2 is a diagrammatic view of processing modules that may be used as a part of an image processing system, such as the image processing system of FIG. 1.

With reference to FIG. 2, there is shown a diagrammatic depiction of modules that may be used as a part of an image processing system 100, which may be implemented using computer instructions that are executed by one or more processors. For example, the image processing system 100 may be implemented on the vehicle 12 as the image processing system 16. The image processing system 100 includes a display modeling module 102, a perceived images module 104, and an image adjustment module 106.

The arrows of FIG. 2 indicate data/processing flow, which begins with the input image 110 and display characteristics input 112 and ends with outputting an adjusted input image to a display, such as the display 36 of the vehicle 12, for displaying the image to a user. In general, the input image 110 and the display characteristics 112 are obtained at the display modeling module 102. The display modeling module 102 is used to determine or obtain properties and/or characteristics of the target display and/or the ideal display. It should be appreciated that FIG. 2 shows modeling for three displays: LCD modeling (for global dimming displays, as an example), local dimming display modeling (for local dimming displays, as an example), and OLED modeling (for the ideal display, as an example). It should be appreciated that each iteration of the process or method includes models for two displays, the ideal display (which may be represented as an OLED model when OLED is considered ideal) and the target display, which may be represented by the LCD modeling (in the case of global dimming displays) or the local dimming display modeling. At the perceived images module 104, used to model or simulate a perceived appearance of the input image according to (or when displayed on) a target display, such as the display 36 of the vehicle 12, and an ideal display, which may be a virtual display that is characterized by one or more predetermined display characteristics or properties. These perceived appearances are referred to as a target display perceived appearance and an ideal display perceived appearance. At the image adjustment module 106, pixel compensation and/or color correction is performed based on the target display perceived appearance and the ideal display perceived appearance. The adjusted input image may then be sent to the target display, such as the display 36 of the vehicle 12, for display.

The display modeling module 102 and the perceived images module 104 are used to generate the target display perceived appearance and the ideal display perceived appearance, or at least a difference in target display perceived appearance and the ideal display perceived appearance, which is then used by the image adjustment module 106. The target display perceived appearance and the ideal display perceived appearance (or the difference in the target display perceived appearance and the ideal display perceived appearance) may be obtained by executing a simulation that generates luminance values representing the outputs the target display perceived appearance and luminance values representing the ideal display perceived appearance.

At least according to one embodiment, the simulation is used to simulate the perceived appearance of the input image by the Human Vision System (HVS) when displayed on different types of electronic displays. The simulation is used to recreate the input image as it would be perceived on the target display, which may be a global dimming display or a local dimming display, and the ideal display. As mentioned above, a global dimming display is a display where the backlight is spread uniformly over the liquid crystal panel or other analogous panel (in non-LCD applications), and a local dimming display is a display with backlight zones that are controlled independently to deliver different backlight distribution across the display. An ideal display is a display with selected characteristics (which may be considered better or more ideal than those of the target display, but not necessarily): a high luminance (similar to global dimming display), and high contrast ratio (similar to an OLED display). Recreating the images on the different displays (target display and ideal display) helps in applying the compensation algorithm on the global or local dimming display to match the quality or output of the ideal display when displaying the input image.

The pixel compensation may be determined from the luminance difference between the target display and the ideal display. The simulation followed by the pixel compensation target the light leakage and the halo effect problems of the global and the local dimming displays. Thus, applying the pixel compensation into the images before displaying them on an electronic device enhances the image quality of different global and local dimming displays. The global dimming, local dimming, and ideal displays simulation includes three different modules: (1) the backlight extraction module, (2) the diffuser module, and (3) the combination nodule. According to at least some embodiments, all the three modules together form the simulation of the display.

The backlight extraction module may use one or more methods or techniques to extract the backlight from the input signal. For example, some techniques that have been developed to extract the backlight, which may be a light emitting diode (LED) backlight, from the input signal include:

(1) The average technique in which the average luminance of each zone of the backlight is extracted. Some information in bright region is lost when applying the average technique.

(2) The maximum technique, which takes the maximum luminance from the signal in each zone and applies it to the backlight panel. According to embodiments, this technique does not save nor optimize any power consumption. Also, this technique causes an increasing in the light leakage from bright to dark regions and, thus, may cause an intense halo effect around bright objects.

(3) Another technique combines the maximum technique and the average technique by computing the weighted mean of the maximum and average pixel values.

Figure 3A:
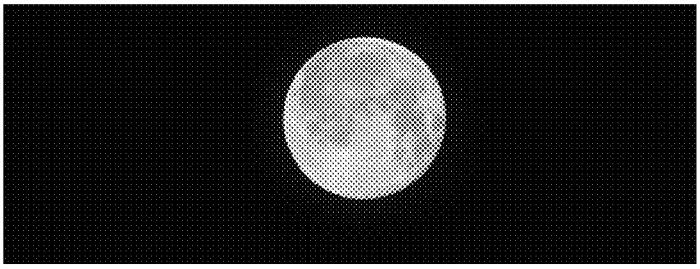
FIG. 3A is an example of an input (e.g., an sRBG image) in its original form.
Figure 3B:
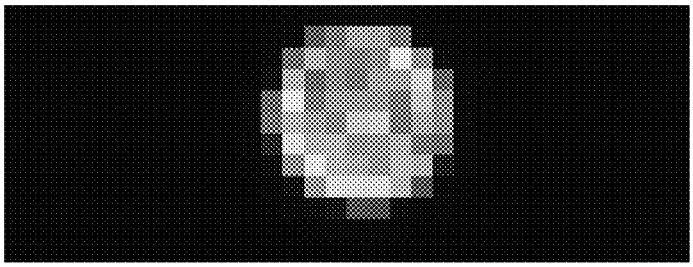
FIG. 3B is an example of shows backlight extraction of the image of FIG. 3A for a 12×32 local dimming display with 1080×720 pixel using a dynamic threshold technique.

In the simulation of the image processing system 100, two different techniques may be adopted: (1) the maximum technique, to preserve the information in bright contents; and (2) a dynamic threshold technique using adaptive backlight extraction based on dynamic threshold and the maximum grayscale of an image block, which is proposed in Zhang, T., et al. (2019). "High-performance local-dimming algorithm based on image characteristic and logarithmic function." Journal of the Society for Information Display 27(2): 85-100. The number of zones in the backlight panel can range from 1 zone for the simulation of a global dimming display to the same number of pixels of the display, which may be in case of the ideal display. FIG. 3A shows an example of an sRGB image in its original form, and FIG. 3B shows the image of FIG. 3A with its backlight extraction for a 12×32 local dimming display with 1080×720 pixel using the dynamic threshold technique.

The diffuser module is used to provide luminance values for a display, and is particularly relevant to displays other than global dimming displays. The diffuser module may use one or more of the techniques below to obtain the luminance values for the display. In one embodiment where the target display is a global dimming display, the diffuser module may not be needed or may simply provide that the intensity map value is equal to the maximum of the global dimming display luminance. For the ideal display, it may be predetermined or determined that the intensity map is the luminance values of the input image (e.g., the sRGB image, such as shown in FIG. 3A). In embodiments where the target display is a local dimming display, then one or more techniques below may be used to generate an intensity map having the luminance values.

Figure 4:
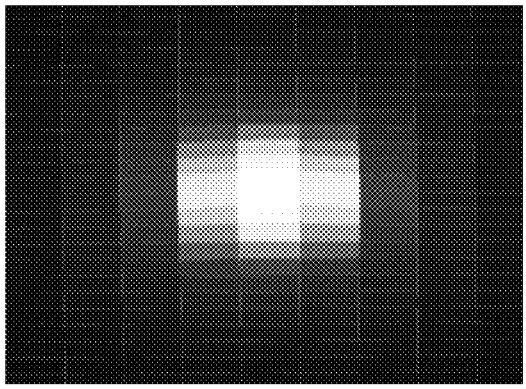
FIG. 4 shows a generated patch from measured data for light of one LED spread on top of a diffuser panel.
Figure 5:
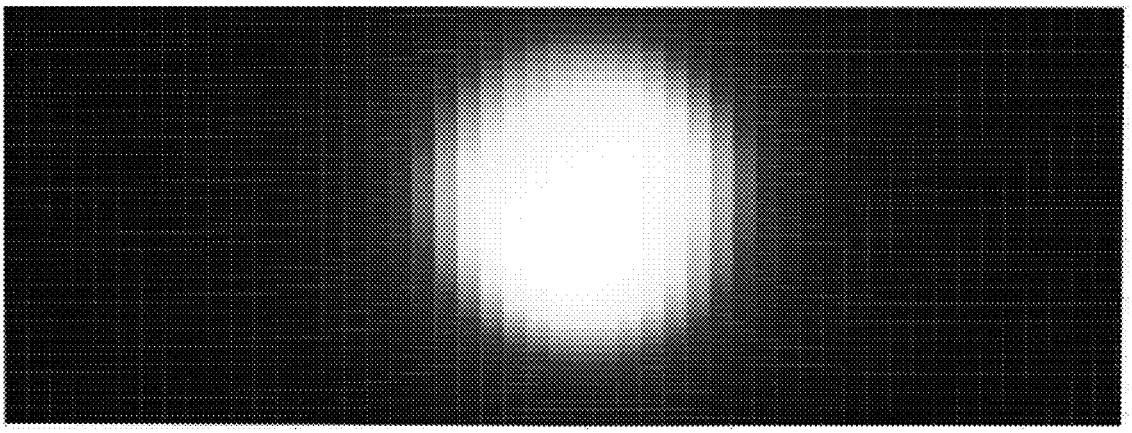
FIG. 5 shows an intensity map of a simulation (e.g., the target display (local dimming) simulation) with the Light Spread Function.
Figure 6A:
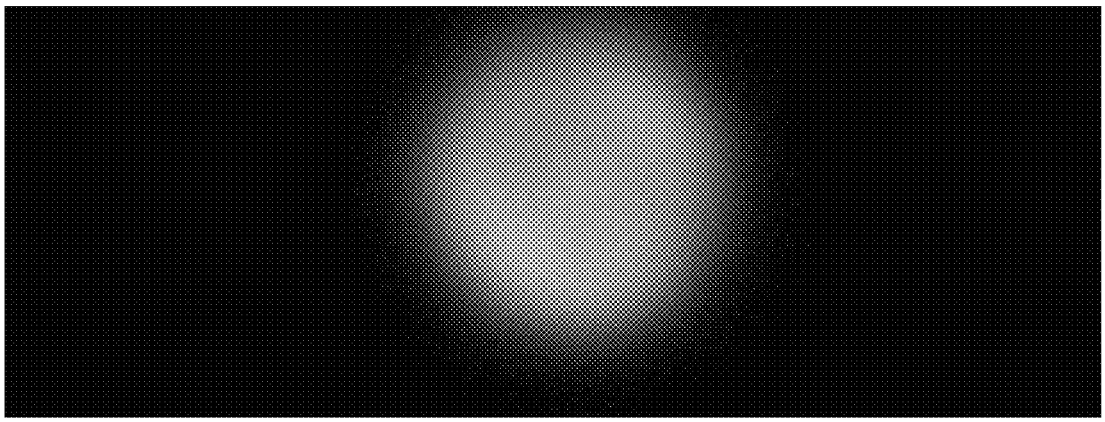
FIGS. 6A and 6B show the diffuser simulation based on a low pass filter (LPF) technique (FIG. 6A) and based on a Light Spread Function (LSF) technique (FIG. 6B)
Figure 6B:
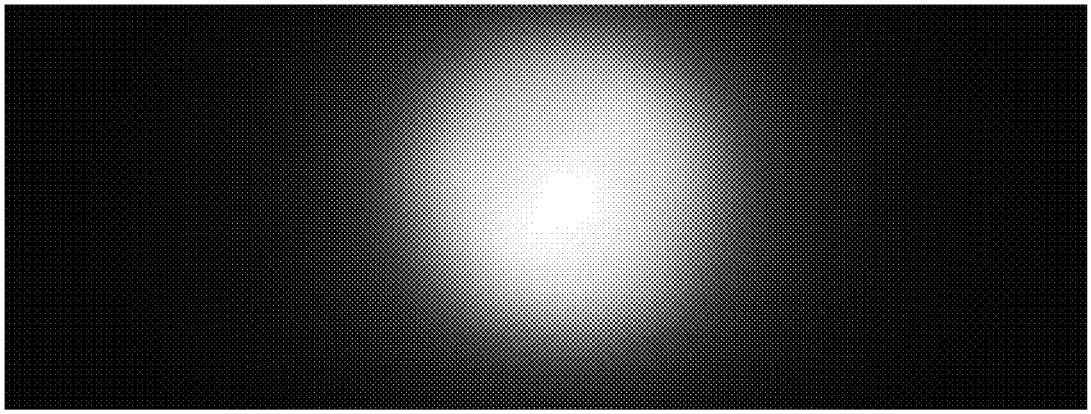

For the diffuser module, a first technique is based on the low pass filter (LPF) developed by Liao, L.-Y. and Y.-P. Huang (2010). "Blur-Mask Approach for Real-Time Calculation of Light Spreading Function (LSF) on Spatial Modulated High Dynamic Range LCDs." Journal of Display Technology 6(4): 121-127; and a second technique that uses real measurement data to compute the Light Spread Function (LSF) of the backlight light sources (e.g., backlight LEDs) on the diffuser panel. FIG. 4 shows the generated patch from the measured data for the light of one LED spread on the top of the diffuser panel. This information is used to replicate any pattern on the backlight LED panel into a light intensity map, such as in FIG. 5. The diffuser module returns the luminance values on the diffuser. FIGS. 6A and 6B show the diffuser simulation with the LPF (FIG. 6A) and the LSF (FIG. 6B). FIG. 5 shows the intensity map of the simulation with the Light Spread Function.

Figure 7:
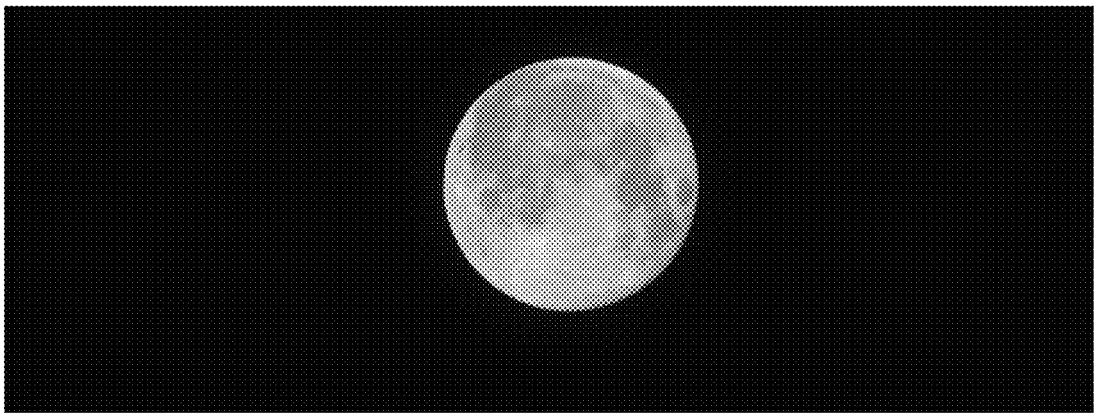
FIG. 7 shows an exemplary perceived appearance of the input image of FIG. 3A on an ideal display.

The pure black and white parameters are added to the diffuser model to enhance the accuracy of the simulation. Equation 2 shows how the luminance, D, of the output of the diffuser model is compensated by the pure black, B, and the pure white, W, parameters. The pure white parameter, W, is the maximum luminance of the global dimming display or the maximum luminance of the zone on a local dimming display, and the pure black, B, is the maximum luminance, W, divided by the contrast ratio, CR, of the display, Equation 1. The output of the combination model can be shown in FIG. 7, which shows the perceived appearance of the input image on the ideal display.

$$B = \frac{W}{CR} \qquad \text{Equation 1}$$

$$Y_{comp} = D*(W-B)+B \qquad \text{Equation 2}$$

The combination module is the modulation of the top layer of the display, and this module combines the luminance values from the diffuser module with the transmittance of the display (the RGB values of the displayed content) and the light leakage factor of the display. Equation 3 shows the values from the diffuser model converted to perceptual uniform encoding, $D_{PU}$ (Aydin, T., et al. (2008). Extending quality metrics to full luminance range images, SPIE), then multiplied by the transmittance, T, of the display, then, the amount of the light leakage, μ, is added (Korhonen, J., et al. (2011). Modeling LCD displays with local backlight dimming for image quality assessment. Electronic Imaging).

$$RGB_{PU} = D_{PU}*T+\mu*(D_{PU}*(1-T)) \qquad \text{Equation 3}$$

Simulation parameters that may be used as a part of the above-described techniques are described below. To generate the backlight map, the input image (e.g., an sRGB image) is given with the type of display that is to be simulated (such as local dimming, global dimming, or ideal dimming) and the size of the display (e.g., 1920×720 pixel). For a global dimming display, the backlight is a uniform intensity map. The intensity map value is equal to the maximum of the global dimming display luminance. For a local dimming display, the number of zones is given (e.g., 10×24 zones), as well as the maximum luminance of the display, the technique of backlight extraction (e.g., maximum or adaptive), and the contrast ratio of the display. The diffuser module uses a technique for generating the intensity map for the local dimming display, as described above, and this technique could be the LPF or the LSF technique described above. For the ideal display, the intensity map is the luminance value of the input image (e.g., the sRGB image). The combination model takes the light leakage, the contrast ratio of the displays, and the maximum luminance as inputs and generates the perceived image on one of the three displays, which may be the target display perceived appearance (for the target display) or the ideal display perceived appearance (for the ideal display).

The image adjustment module 106 uses a pixel compensation technique, which is based on the target display perceived appearance and the ideal display perceived appearance, to adjust the input image so as to obtain an adjusted input image. The first approach is a luminance matching technique that determines a compensation ratio that is then applied to the input image to obtain the adjusted input image. This approach may also be referred to as a compensation ratio technique. The compensation ratio represents a ratio between luminance values representing the ideal display perceived appearance and luminance values representing the target display perceived appearance. This first approach is applicable to local dimming displays and global dimming displays. The second approach is referred to as a luminance retargeting technique and includes a luminance retargeting process that performs luminance retargeting from luminance values of the ideal display perceived appearance to the target display perceived appearance. This second approach is applicable to local dimming displays.

Figure 8:
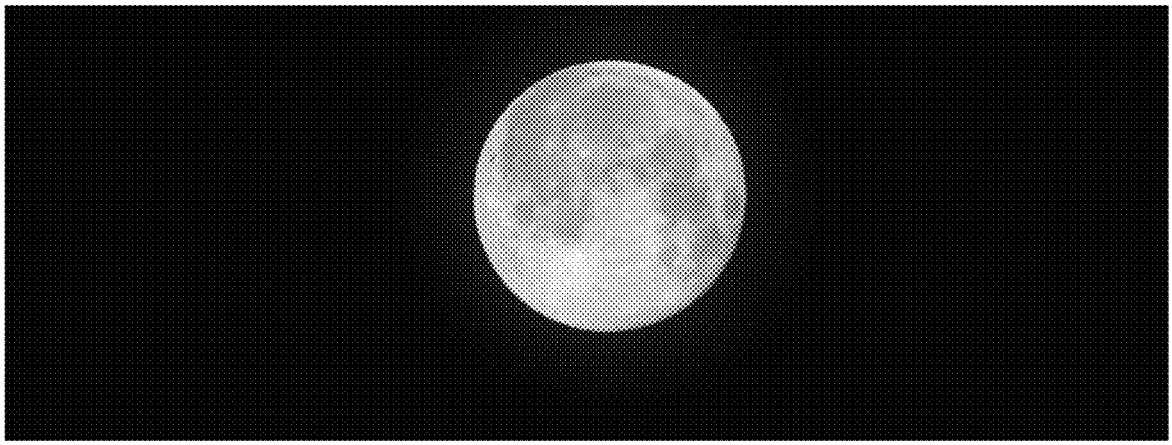
FIG. 8 shows an example of the compensated image (or adjusted input image) for the local dimming display based on applying a compensation ratio technique.

The compensation ratio technique is based on the difference in luminance values between the perceived images generated by the combination model for the local-global dimming and the ideal display. The input image is first converted to the linear space using the sRGB to RGB conversion. The luma values are extracted from the perceived images on a local dimming display (or otherwise obtained, such as for a global dimming display) and the ideal display and then converted to their luminance values. The compensation ratio between the ideal luminance (luminance of the ideal display) and the luminance of the target display (luminance of the local or global dimming display) is computed following Equation 4.

$$Ratio_{comp} = \frac{Y_{ideal}}{Y_{target}} \quad \text{Equation 4}$$

where $Y_{target}$ is $Y_{local}$ or $Y_{global}$ depending on whether the target display is a local dimming display or a global dimming display. The input linear image is then multiplied by the compensation ratio from Equation 4 to obtain the adjusted input image. After the compensation ratio is applied, the adjusted input image may be gamma corrected. This compensation ratio technique can be applied for both: a local dimming display (as the target display) and a global dimming display (as the target display). FIG. 8 shows an example of the compensated image (or adjusted input image) for the local dimming display with the compensation ratio technique.

Figure 9:
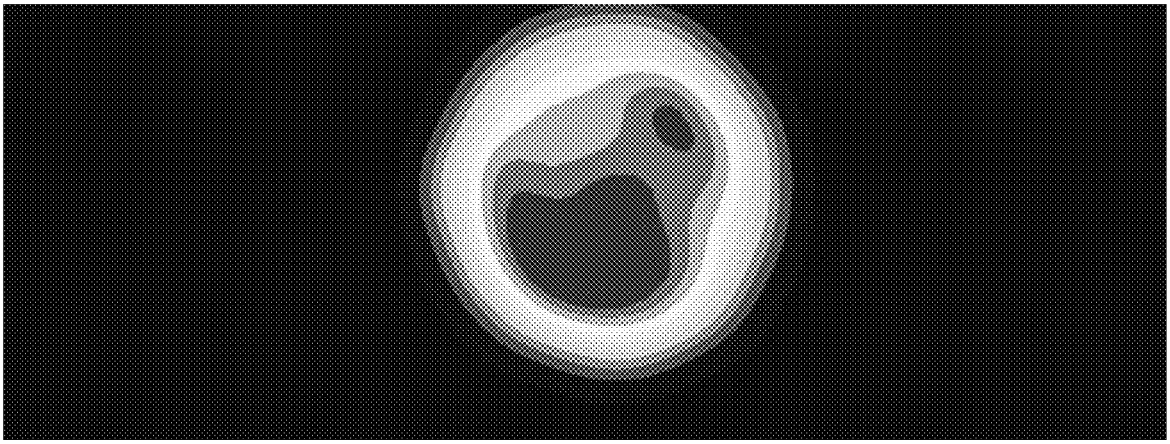
FIG. 9 shows an example of 10 different luminance zones extracted based on Otsu's thresholding method (or Otsu's method)
Figure 10:
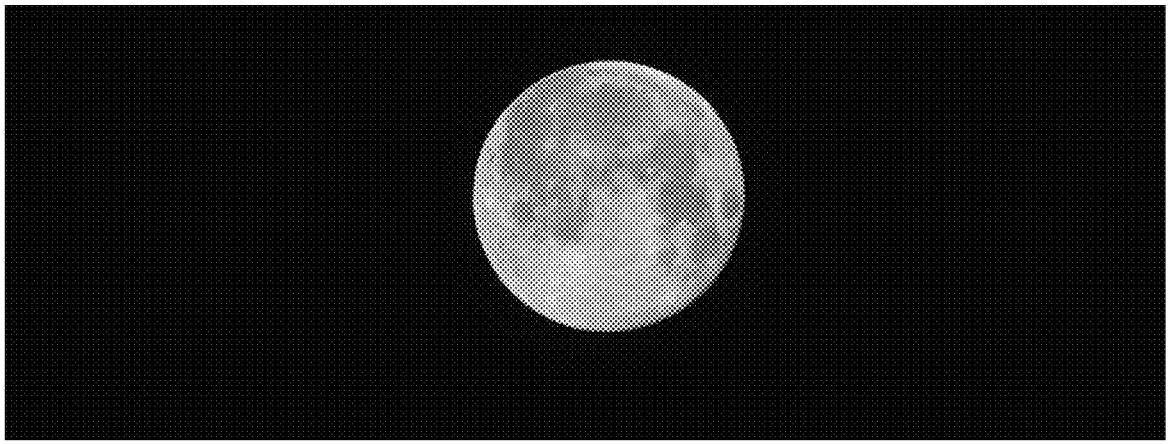
FIG. 10 shows an example of the compensated image (or adjusted input image) based on applying a luminance retargeting technique.

The second pixel compensation technique, the luminance retargeting technique, includes a luminance retargeting process that performs luminance retargeting from luminance values of the ideal display perceived appearance to the target display perceived appearance. This technique is adopted from U.S. Pat. No. 10,217,197. In this application, the luminance retargeting from the source display to the target display is used. Here, the source display is the ideal display and, for example, with maximum luminance equal to 1000 cd/m2. The target display is a local dimming display. The local dimming display is split into a predetermined number (e.g., 10) of different luminance zones, where each zone has a target luminance. Then, the technique for luminance retargeting from U.S. Pat. No. 10,217,197 is applied. FIG. 9 shows an example of 10 different luminance zones extracted based on Otsu's thresholding method (or Otsu's method). Each zone is then retargeted by a different tone curve, which may be generated or obtained from a look up table. An example of the compensated image (or adjusted input image) with the luminance retargeting technique is shown in FIG. 10.

The compensated image (or adjusted input image) from the compensation ratio technique and/or the luminance retargeting technique is then used as input to be displayed on the target display.

Figure 11:
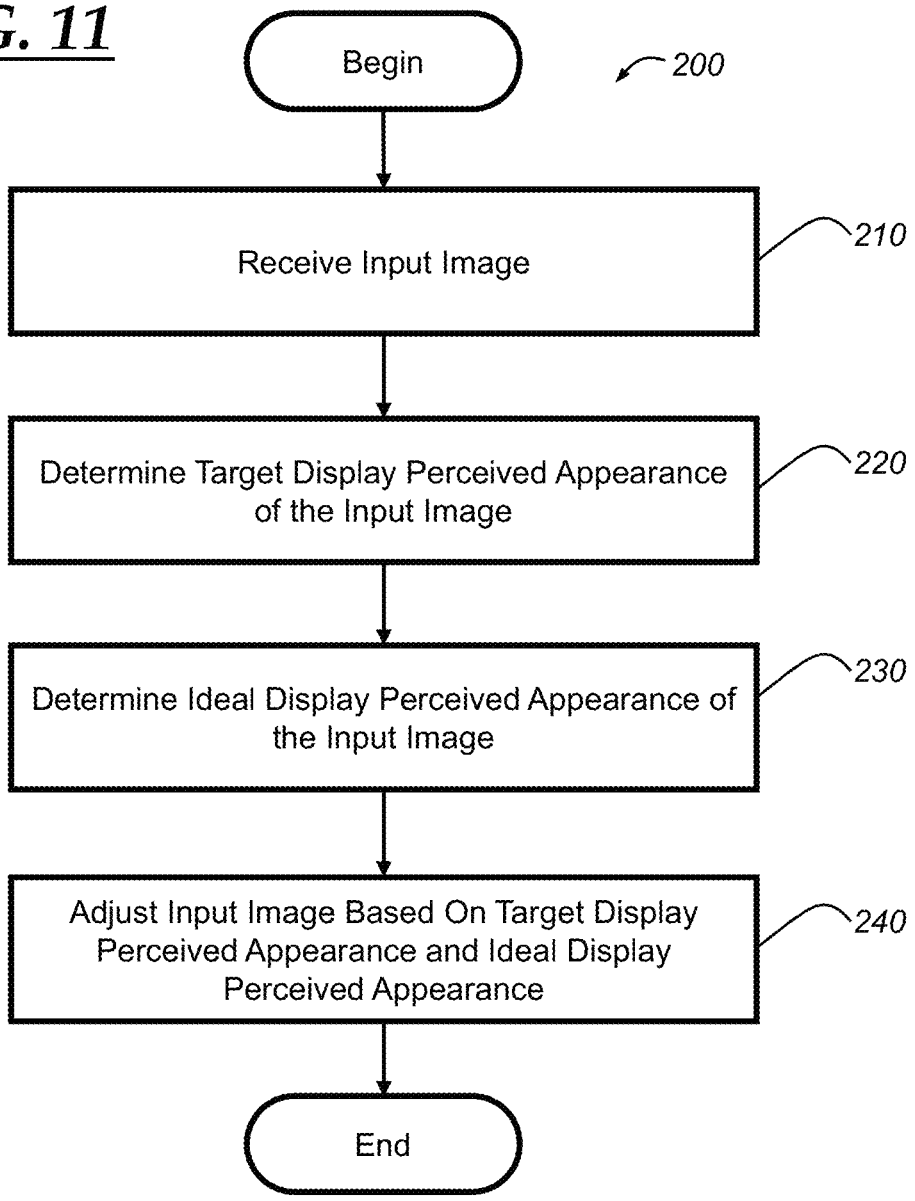
FIG. 11 shows a flowchart depicting a method of adjusting an input image based on a perceived appearance of the input image on a target display and on an ideal display.

With reference to FIG. 11, there is shown an embodiment of a method 200 of adjusting an input image based on a perceived appearance of the input image on a target display and on an ideal display. According to at least some embodiments, the method 200 is used to generate an adjusted input image that is then displayed on the target display, such as the in-vehicle display 36 of the vehicle 12. In one embodiment, the method 200 is carried out by an onboard controller of a vehicle, such as the onboard vehicle controller 30 of the vehicle 12.

The method 200 begins with step 210, wherein an input image is received. The input image may be represented as an electronic data file that is stored in memory of the vehicle 16, such as in the memory 42 of the onboard vehicle controller 30 of the vehicle 12. The input image may be an sRGB image, for example. In some embodiments, the input image may be pre-stored graphics, images, or a combination thereof. In another embodiment, the input image may be obtained from a camera of the vehicle 16, such as one of the camera(s) 32 of the vehicle 12. In some embodiments, the input image may be a combination of one or more predetermined graphics or images (collectively, predetermined images) and one or more images captured from the camera 32. In some embodiments, the input image is received at the onboard vehicle controller 30 of the vehicle 12. In one embodiment, a portion of the input image or the whole input image may be sent from the backend server(s) 18 to the vehicle 12 and received at the onboard vehicle controller 30. The method 200 continues to step 220.

In step 220, a target display perceived appearance of the input image is determined. The target display perceived appearance represents a perceived appearance of the input image according to a target display. The target display perceived appearance may be determined as a result of a simulation of the input image as displayed on the target display, which may be referred to as the target display simulation. The target display simulation outputs the target display perceived appearance as a plurality of luminance values, which are referred to as target display luminance values. The simulation technique described above with respect to FIGS. 2-7 may be used here for the target display simulation. The method 200 proceeds to step 230.

In step 230, an ideal display perceived appearance of the input image is determined. The ideal display perceived appearance represents a perceived appearance of the input image according to an ideal display. The ideal display may be represented by a plurality of display characteristics (i.e., one or more display characteristics and/or properties) including luminance and contrast. The ideal display perceived appearance represents a perceived appearance of the input image according to an ideal display. The ideal display perceived appearance may be determined as a result of a simulation of the input image as displayed on the ideal display, which may be referred to as the ideal display simulation. The ideal display simulation outputs the ideal display perceived appearance as a plurality of luminance values, which are referred to as ideal display luminance values. The simulation technique described above with respect to FIGS. 2-7 may be used here for the ideal display simulation. It should be noted that the simulation technique for the ideal display simulation may be slightly different than that used for the target display simulation. For example, the ideal display simulation may use a predetermined intensity map that has the luminance values of the input image (e.g., the sRGB image) instead of generating an intensity map of luminance values, as may be done for the target display simulation. The method 200 continues to step 240.

In step 240, the input image is adjusted based on the target display perceived appearance and the ideal display perceived appearance. In some embodiments, a pixel compensation technique is used to generate the adjusted input image. In one embodiment, such as where the target display is a global dimming display or a local dimming display, the pixel compensation technique may be the compensation ratio technique described above, which is based on the difference in luminance values between the target display perceived appearance and the ideal display perceived appearance. In another embodiment, such as where the target display is a local dimming display, the pixel compensation technique may be the luminance retargeting technique described above, which includes a luminance retargeting process that performs luminance retargeting from luminance values of the ideal display perceived appearance to the target display perceived appearance. The method 200 ends.

Figure 12:
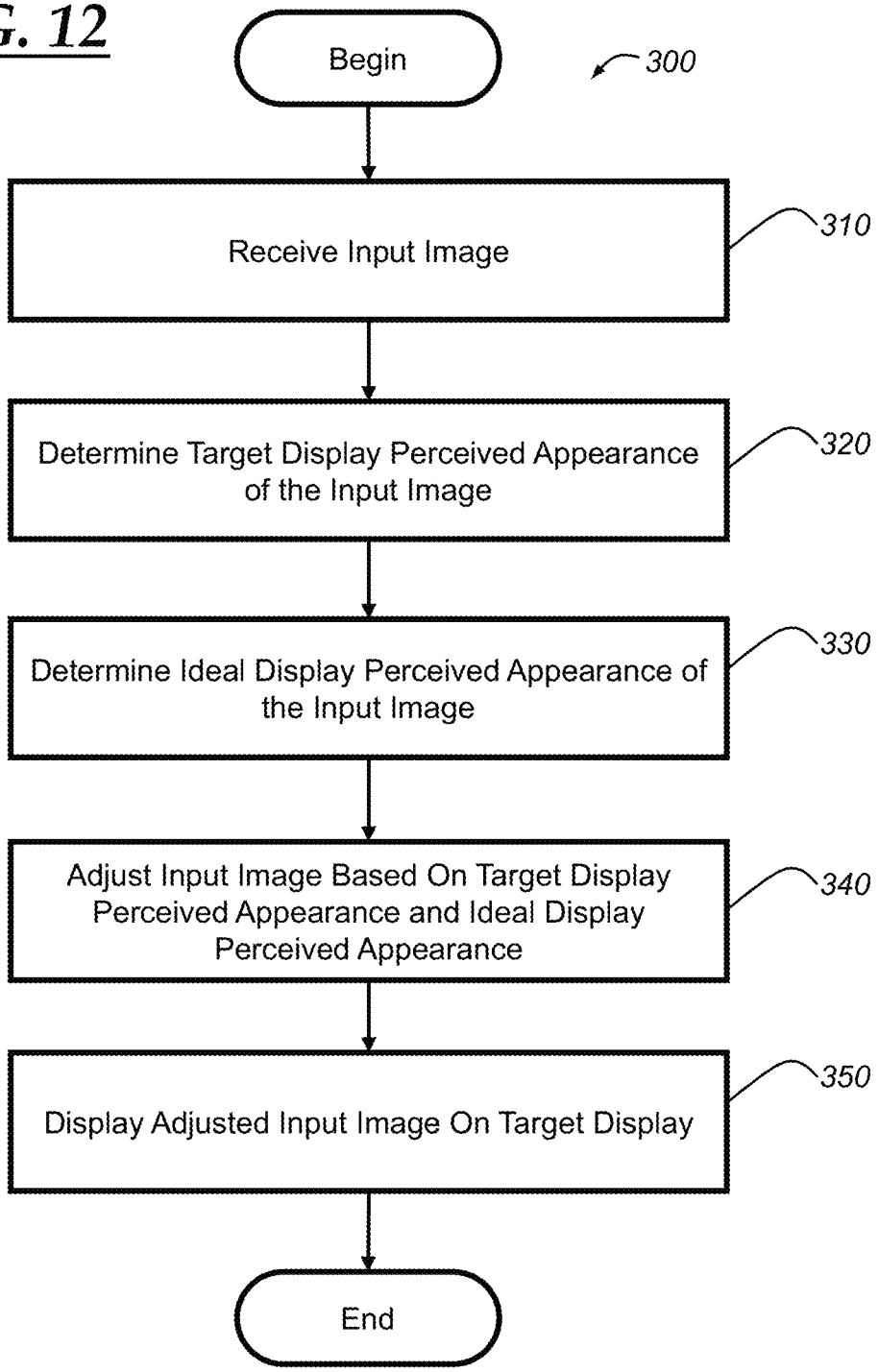
FIG. 12 shows a flowchart depicting a method of displaying an adjusted input image.
Figure 13:
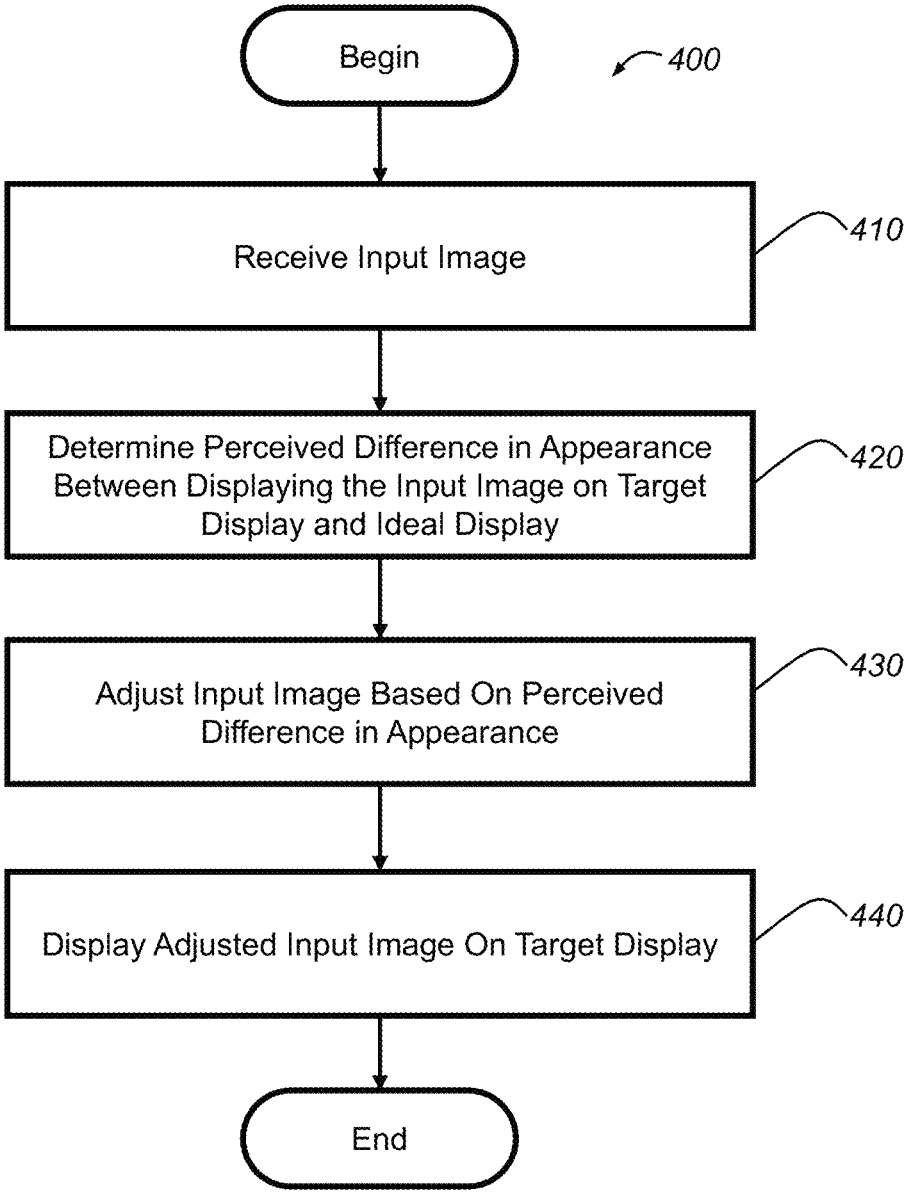
FIG. 13 shows a flowchart depicting a method of displaying an adjusted input image, including a method of adjusting an input image based on a perceived appearance of the input image on a target display and on an ideal display.

With reference to FIG. 12, there is shown a method 300 of displaying an adjusted input image. The method 300 includes steps 310, 320, 330, and 340, which are the same as steps 210, 220, 230, and 240 of the method 200 (FIG. 11), respectively. The method 300 further includes a step 350 of displaying the adjusted input image on the target display. In this step, the adjusted input image is sent to the target display for being displayed, such as for viewing by a user. The target display may be the display 36 of the vehicle 12, for example. In such an example, the adjusted input image may be sent from the onboard vehicle controller 30 to the display 36 via the communications bus 38 (or directly from the controller 30 to the display 36 where a suitable direct connection exists). The method 300 then ends.

With reference to FIG. 13, there is shown a method 400 of adjusting an input image based on a perceived appearance of the input image on a target display and on an ideal display (steps 410-430) and a method of displaying an adjusted input image (steps 410-440). In step 410, an input image is received. This step is analogous to step 210 and that discussion is hereby incorporated and attributed to step 410. Then, in step 420, a perceived difference in appearance between displaying the input image on a target display and an ideal display. This may be determined as a part of using the pixel compensation technique. For example, when using the compensation ratio technique, the compensation ratio represents a perceived difference in appearance between displaying the input image on a target display and an ideal display as this ratio is based on the target display perceived appearance and the ideal display perceived appearance. With respect to the luminance retargeting technique, a tone curve may be determined for each zone, and selection of a predetermined tone curve (or even derivation of a tone curve) may be determined based on a perceived difference in appearance between displaying the input image on a target display and an ideal display as this selection is based on the target display perceived appearance and the ideal display perceived appearance. The method 400 continues to step 430.

In step 430, the input image is adjusted based on the perceived difference in appearance. For example, when using the compensation ratio technique, the compensation ratio may be applied to the input image to generate the adjusted input image. And, for example, when using the luminance retargeting technique, the selected tone curves may be applied to the input image to generate the adjusted input image. The method 400 then continues to step 440. The step 440 is analogous to step 350 of the method 300 and that discussion is hereby incorporated and attributed to the step 440. The method 400 ends.

In other embodiments, the methods 200, 300, and/or 400 as well as the image processing system described above may be used in non-vehicular applications, such as for image processing of images on a handheld mobile device, such as a smartphone, or on a personal computer, such as a laptop or desktop computer.

Figure 14A:
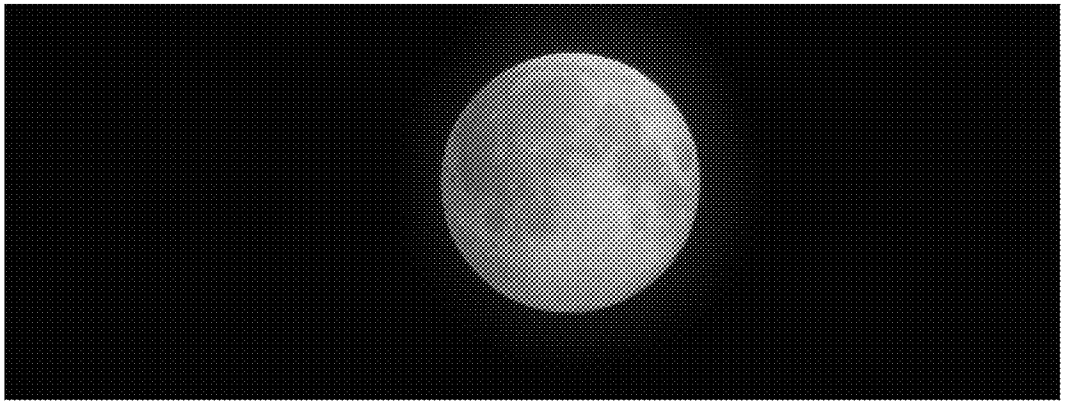
FIG. 14A shows an input image as it appears when displayed on a target display.
Figure 14B:
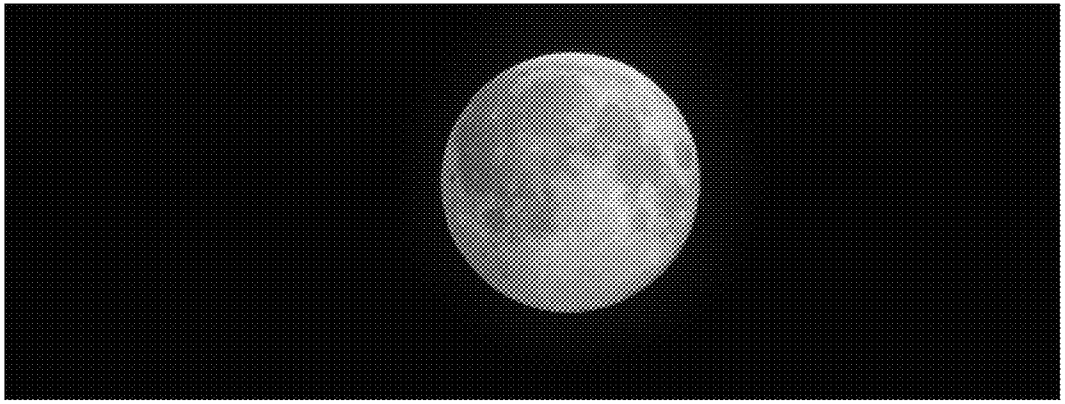
FIG. 14B shows an adjusted input image (the input image as adjusted using, for example, a pixel compensation technique) as it appears when displayed on the target display.

To assess the image quality of the display, the PU-SSIM metric is used. The ideal simulated image is used as reference, and we compute the PU-SSIM for both local and global dimming display with the original image and the compensated images displayed on the simulated local and global dimming displays. The results show higher image quality for both compensated (adjusted) images compared to the original image when displayed on the local and global dimming display. Table 1 shows the PU-SSIM values for different local dimming configuration in comparing to the global dimming and the ideal display. The ideal display the local dimming and the global dimming display all have a maximum luminance value of 1000 cd/m2, and the contrast ratio of the ideal display is 1,000,000:1 and the local and global dimming display have a contrast ratio of 2,000:1. Moreover, by visual comparison, the halo effect appears reduced around bright objects with a dark background (not pure black background), where the two compensated method were able to reduce the black level in the area around bright objects. For example, with respect to FIGS. 14A and 14B, there is shown a comparison of the input image as displayed on the target display at 502 and the adjusted (or compensated) input image as displayed on the target display at 504. The adjusted input image has better contrast and reduces the halo effect. Furthermore, a better effective contrast ratio in each image was noticed after applying the two pixel compensation techniques.

TABLE 1

PU-SSIM values for different local dimming displays (LD) and one global dimming display (GD) compared to the ideal display

| Array dimension | Number of Zones | Ideal display | LD Method 1 | LD Method 2 | LD Original | GD Method 1 | GD original |
|---|---|---|---|---|---|---|---|
| 6 × 16 | 96 | 1 | 0.76 | 0.78 | 0.69 | 0.73 | 0.65 |
| 9 × 24 | 216 | 1 | 0.78 | 0.80 | 0.72 | 0.73 | 0.65 |

TABLE 1-continued

PU-SSIM values for different local dimming displays (LD) and one global dimming display (GD) compared to the ideal display

| Array dimension | Number of Zones | Ideal display | LD Method 1 | LD Method 2 | LD Original | GD Method 1 | GD original |
|---|---|---|---|---|---|---|---|
| 12 × 32 | 384 | 1 | 0.80 | 0.82 | 0.74 | 0.73 | 0.65 |
| 15 × 40 | 600 | 1 | 0.81 | 0.83 | 0.76 | 0.73 | 0.65 |
| 18 × 48 | 864 | 1 | 0.83 | 0.85 | 0.78 | 0.73 | 0.65 |
| 24 × 64 | 1536 | 1 | 0.85 | 0.86 | 0.80 | 0.73 | 0.65 |

The results show the capacity of the above methods in reproducing images similar to the perceived images on an electronic device. Applying both pixel compensation methods to the original (or input) images shows enhancement in the image quality, the effective contrast ratio, and in the reduction of the halo effect. More elements to the simulation can be added, such as the glare effect in the human eye, the effect of the viewing angle of the display on the light leakage, and the ambient light reflection. Both developed methods for pixel compensation presented in this work can also be used to target the above elements and compensate for the luminance difference between the target and the reference (or ideal) displays.

All references to processing or executing instructions by a processor (including at least one processor or one or more processors) means that said processing or executing instructions is performed by at least one processor and, in at least such implementations and according to some embodiments, said processing or executing instructions is performed by a plurality of processors, any or all of which may be co-located or remotely located. Any one or more of the processors discussed herein are electronic processors that may be implemented as any suitable electronic hardware that is capable of processing computer instructions and may be selected based on the application in which it is to be used. Examples of types of electronic processors that may be used include central processing units (CPUs), graphics processing units (GPUs), field-programmable gate arrays (FPGAs), application specific integrated circuits (ASICs), microprocessors, microcontrollers, etc. Any one or more of the computer-readable memory discussed herein may be implemented as any suitable type of non-transitory memory that is capable of storing data or information in a non-volatile manner and in an electronic form so that the stored data or information is consumable by the electronic processor.

The memory may be any a variety of different electronic memory types and may be selected based on the application in which it is to be used. Examples of types of memory that may be used include including magnetic or optical disc drives, ROM (read-only memory), solid-state drives (SSDs) (including other solid-state storage such as solid-state hybrid drives (SSHDs)), other types of flash memory, hard disk drives (HDDs), non-volatile random access memory (NVRAM), etc. It should be appreciated that the computers or servers may include other memory, such as volatile RAM that is used by the electronic processor, and/or may include multiple processors.

It is to be understood that the foregoing description is of one or more embodiments of the invention. The invention is not limited to the particular embodiment(s) disclosed herein, but rather is defined solely by the claims below. Furthermore, the statements contained in the foregoing description relate to the disclosed embodiment(s) and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation. In addition, the term "and/or" is to be construed as an inclusive OR. Therefore, for example, the phrase "A, B, and/or C" is to be interpreted as covering all of the following: "A"; "B"; "C"; "A and B"; "A and C"; "B and C"; and "A, B, and C."

The invention claimed is:

1. A method for adjusting an input image based on a perceived appearance of the input image on a target display and on an ideal display, wherein the method comprises:

receiving an input image;

determining a target display perceived appearance of the input image, wherein the target display perceived appearance represents a perceived appearance of the input image according to a target display;

determining an ideal display perceived appearance of the input image, wherein the ideal display perceived appearance represents a perceived appearance of the input image according to an ideal display; and adjusting the input image based on the target display perceived appearance and the ideal display perceived appearance.

2. The method of claim 1, wherein the target display perceived appearance is determined as a result of a target display simulation, and wherein target display simulation is a simulation of the input image as displayed on the target display.

3. The method of claim 1, wherein the ideal display perceived appearance is determined as a result of an ideal display simulation, and wherein ideal display simulation is a simulation of the input image as displayed on the ideal display.

4. The method of claim 1, wherein a target display simulation outputs the target display perceived appearance as a plurality of luminance values referred to as target display luminance values, and an ideal display simulation outputs the ideal display perceived appearance as a plurality of luminance values referred to as ideal display luminance values.

5. The method of claim 1, wherein the ideal display is represented by a plurality of display characteristics including luminance and contrast.

6. The method of claim 1, wherein the adjusting step includes performing a pixel compensation process on the input image, wherein the pixel compensation process is based on the target display perceived appearance and the ideal display perceived appearance.

7. The method of claim 6, wherein the pixel compensation process includes determining a ratio between luminance values representing the ideal display perceived appearance and luminance values representing the target display perceived appearance.

8. The method of claim 7, wherein the ratio is applied to the input image as a part of adjusting the input image to obtain the adjusted input image.

9. The method of claim 6, wherein the pixel compensation process includes a luminance retargeting process that performs luminance retargeting from luminance values of the ideal display perceived appearance to the target display perceived appearance.

10. A method for adjusting an input image based on a perceived appearance of the input image on a target display and on an ideal display, comprising the steps of:

receiving an input image;

determining a perceived difference in appearance between displaying the input image on a target display and an ideal display, wherein the perceived difference in appearance is based on a simulation of the input image as displayed on the target display and a simulation of the input image as displayed on the ideal display; and adjusting the input image based on the perceived difference in appearance between displaying the input image on a target display and an ideal display.

11. An image processing system comprising:

at least one processor; and memory storing computer instructions that are accessible by the at least one processor;

wherein the at least one processor is configured to execute the computer instructions, and, when the at least one processor executes the computer instructions, the system:

receives an input image;

determines a target display perceived appearance of the input image, wherein the target display perceived appearance represents a perceived appearance of the input image according to a target display;

determines an ideal display perceived appearance of the input image, wherein the ideal display perceived appearance represents a perceived appearance of the input image according to an ideal display; and adjusts the input image based on the target display perceived appearance and the ideal display perceived appearance.

12. The system of claim 11, wherein the target display perceived appearance is determined as a result of a target display simulation, and wherein target display simulation is a simulation of the input image as displayed on the target display.

13. The system of claim 11, wherein the ideal display perceived appearance is determined as a result of an ideal display simulation, and wherein ideal display simulation is a simulation of the input image as displayed on the ideal display.

14. The method of claim 11, wherein a target display simulation outputs the target display perceived appearance as a plurality of luminance values referred to as target display luminance values, and an ideal display simulation outputs the ideal display perceived appearance as a plurality of luminance values referred to as ideal display luminance values.

15. The method of claim 11, wherein the ideal display is represented by a plurality of display characteristics including luminance and contrast.

16. The method of claim 11, wherein the adjusting step includes performing a pixel compensation process on the input image, wherein the pixel compensation process is based on the target display perceived appearance and the ideal display perceived appearance.

17. The system of claim 16, wherein the pixel compensation process includes determining a ratio between luminance values representing the ideal display perceived appearance and luminance values representing the target display perceived appearance.

18. The system of claim 17, wherein the ratio is applied to the input image as a part of adjusting the input image to obtain the adjusted input image.

19. The system of claim 16, wherein the pixel compensation process includes a luminance retargeting process that performs luminance retargeting from luminance values of the ideal display perceived appearance to the target display perceived appearance.

20. The system of claim 18, further comprising the target display.

* * * * *